US007716887B2

(12) United States Patent
Fouch et al.

(10) Patent No.: US 7,716,887 B2
(45) Date of Patent: May 18, 2010

(54) SHEAR WALL ATTACHMENT ASSEMBLY AND METHOD OF USE

(75) Inventors: Lucas B. Fouch, Boise, ID (US); Scott A. Soule, Boise, ID (US); Miles E. Waltz, Jr., Boise, ID (US); Glen D. Robak, Boise, ID (US)

(73) Assignee: Weyerhaeuser NR Company, Federal Way, WA (US)

( * ) Notice: Subject to any disclaimer, the term of this patent is extended or adjusted under 35 U.S.C. 154(b) by 909 days.

(21) Appl. No.: 11/026,041

(22) Filed: Dec. 30, 2004

(65) Prior Publication Data

US 2006/0144008 A1 Jul. 6, 2006

(51) Int. Cl.
*E02D 27/00* (2006.01)

(52) U.S. Cl. ..... 52/293.3; 52/274; 52/289; 52/295

(58) Field of Classification Search ..... 52/293.3, 52/293.1, 236.9, 236.6, 236.7, 236.8, 266, 52/274, 745.12, 289
See application file for complete search history.

(56) References Cited

U.S. PATENT DOCUMENTS 2,859,486 A * 11/1958 Rovich ..... 52/198
2,883,852 A * 4/1959 Midby ..... 52/236.8
3,323,265 A * 6/1967 Petersen ..... 217/4
5,966,892 A * 10/1999 Platt ..... 52/712
6,497,937 B1 * 12/2002 Lam et al. ..... 428/106
6,668,508 B2 12/2003 Boone et al.
6,931,804 B2 * 8/2005 Trarup et al. ..... 52/295
2002/0046521 A1 * 4/2002 Steinacker, Sr. ..... 52/274
2002/0134037 A1 * 9/2002 Hearne ..... 52/293.3
2003/0041551 A1 * 3/2003 Boone et al. ..... 52/698
2004/0103601 A1 * 6/2004 Bergqvist ..... 52/284

FOREIGN PATENT DOCUMENTS

JP 2001348953 A * 12/2001

* cited by examiner

*Primary Examiner*—Brian E Glessner
*Assistant Examiner*—Adriana Figueroa
(74) *Attorney, Agent, or Firm*—Rachael Vaughn

(57) ABSTRACT

The present invention is a raised floor assembly efficiently connecting a pre-fabricated shear wall to a foundation in applications other than slab-on-grade. The raised floor assembly includes an engineered wood material block machined to accept a connecting rod therethrough. The raised floor assembly also includes a connecting rod that is configured to attach at one end to a pre-fabricated shear wall and is coupled at the other end to an anchor bolt. Additionally, a transfer plate may be positioned between the pre-fabricated shear wall and the top of the engineered wood material block. The transfer plate provides a bearing surface for the pre-fabricated shear wall and helps maintain connecting rod alignment. A transfer plate may also be provided underneath the engineered wood material block and above the foundation. Additionally, a variety of spacers may be provided between the bottom of the engineered wood material block and the foundation.

10 Claims, 5 Drawing Sheets

SHEAR WALL ATTACHMENT ASSEMBLY AND METHOD OF USE

FIELD OF THE INVENTION

This invention relates generally to assemblies for attaching a pre-fabricated shear wall to a concrete foundation in non slab-on-grade construction applications.

BACKGROUND OF THE INVENTION

Pre-fabricated shear walls are commonly used in commercial and residential structures as one method of transferring force, typically shear, a structure into the ground. Consequently, by using a pre-fabricated shear wall, the remaining structure does not have to be designed to carry the shear forces, and as such, lighter or less expensive materials may be used for the remaining structure. Thus, the use of relatively small engineered components to carry specific types of loading, such as pre-fabricated shear walls, helps to reduce the overall cost of the structure.

Historically, pre-fabricated shear walls are generally only used with structures that are slab-on-grade applications. This limited application scope prevents the benefits of a pre-fabricated shear walls from being used in applications where the structure is not a slab-on-grade application. A suitable example of one such application is residential housing where flooring structure, such as joists and sheathing, are built upon the concrete foundation The flooring structure simply interferes with standard pre-fabricated shear walls assemblies as they prevent the attachment of the pre-fabricated shear walls to the foundation. Consequently, the pre-fabricated shear wall simply can not transfer the shear load into the foundation. Attempts have been made to build kits that allow a pre-fabricated shear walls to be used in these non slab-on-grade applications, however, they have proved to be either ineffective or overly cumbersome in their use.

SUMMARY OF THE INVENTION

The present invention is a raised floor assembly that efficiently connects a pre-fabricated shear wall to a foundation in applications other than slab-on-grade. The raised floor assembly includes an engineered wood material block machined to accept a connecting rod there through. The raised floor assembly also includes a connecting rod that is configured to attach at one end to a shear wall and is coupled at the other end to an anchor bolt. Additionally, a transfer plate may be positioned between the pre-fabricated shear wall and the top of the engineered wood material block. A transfer plate may also be provided underneath the engineered wood material block and above the foundation. The transfer plate provides a bearing surface for the pre-fabricated shear wall and also helps maintain connecting rod alignment. Further, the transfer plate transfers the shear loading from the shear wall and connecting rod, into the engineered wood material block, and then back into the connecting rod to be dissipated into an anchor bolt. Additionally, spacers of a variety of arrangements may be provided between the bottom of the engineered wood material block and the foundation.

Another aspect of the present invention is a method of using a pre-fabricated shear wall in construction applications other than slab-on-grade. A pre-fabricated shear wall sized to fit on top of flooring or other structure is provided. Also, an engineered wood material block, sized as needed to operate as intended in a space between the bottom of the pre-fabricated shear wall and the foundation, is inserted between the pre-fabricated shear wall and the foundation. Connecting rods are then run from the pre-fabricated shear wall through the engineered wood material block and to anchor bolts in the foundation. Threaded couplers are used to attach the connecting rods to the pre-fabricated shear wall and anchor bolt. A transfer plate may be used as a bearing surface between the pre-fabricated shear wall and the top of the engineered wood material block. Additionally, the transfer plates serve to transfer shear loading into and from the engineered wood material block. Additionally, any variety of spacers may be used between the engineered wood material block and the foundation. Joist hangers and other structure may then be attached to the engineered wood material block if desired. In this manner, the pre-fabricated shear wall is able to transfer shear force to function as intended without being adversely affected by any flooring structure. Additionally, as joist hangers can be attached directly to the engineered wood material block, joist spacing is not interrupted and floor integrity is maintained.

BRIEF DESCRIPTION OF THE DRAWINGS

The preferred and alternative embodiments of the present invention are described in detail below with reference to the following drawings.

DETAILED DESCRIPTION OF THE INVENTION

Figure 1:
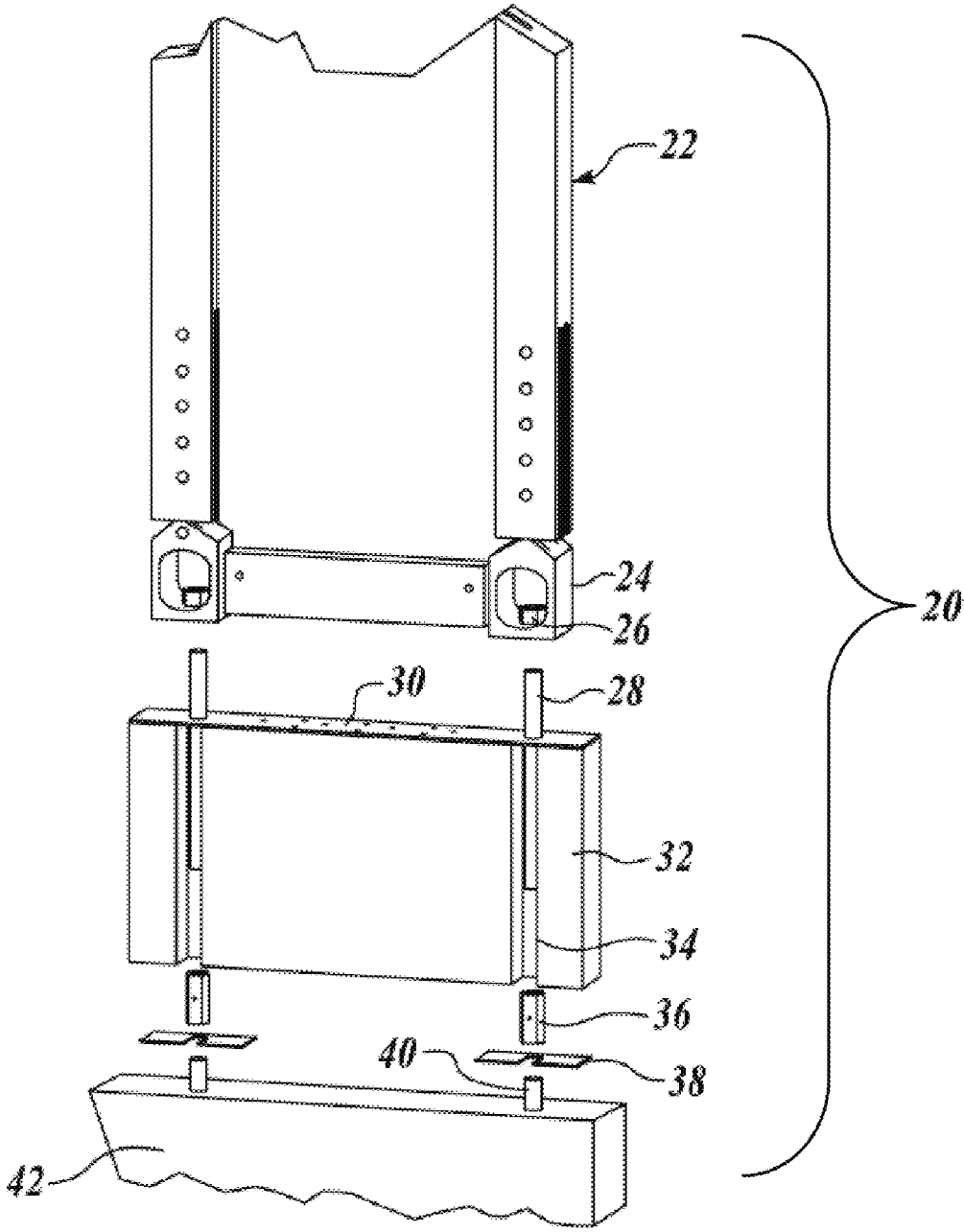
FIG. 1 is a partially exploded view of the raised floor assembly according to an aspect of the present invention.

The present invention provides a system and method for using a pre-fabricated shear wall in building construction applications that are not slab-on-grade applications. By way of overview, and with reference to FIG. 1, an embodiment of the present invention includes a raised floor assembly 20 having a block 32 defining a groove 34 vertically therethrough, a variety of plates and spacers located on top and/or below the block 32 and a connecting rod 28 configured to tie a pre-fabricated shear wall 22 to an anchor bolt 40 of a foundation 42. Specific details of the raised floor assembly 20 are described with more particularity below.

Figure 2:
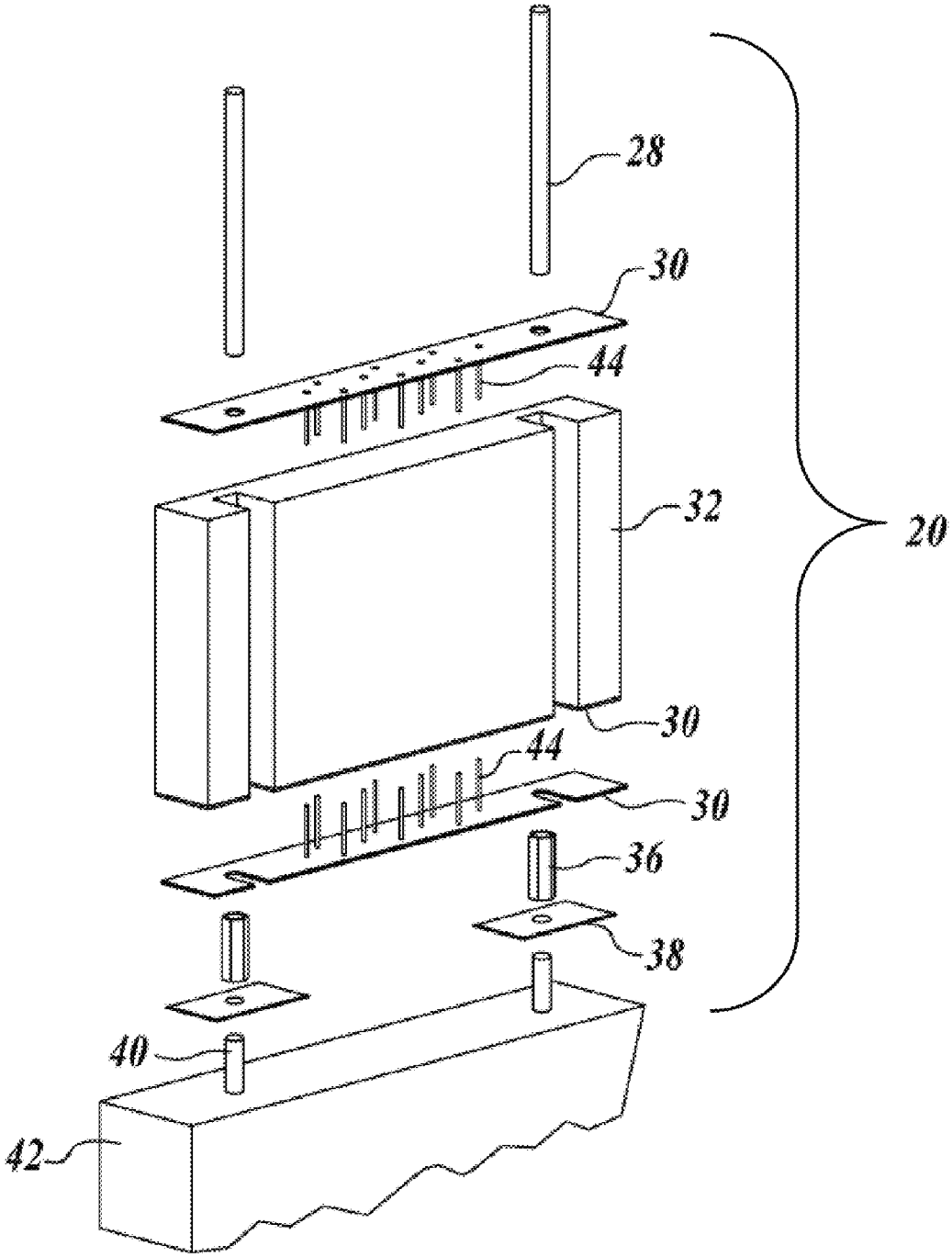
FIG. 2 is another exploded view of another aspect of the present invention.
Figure 3:
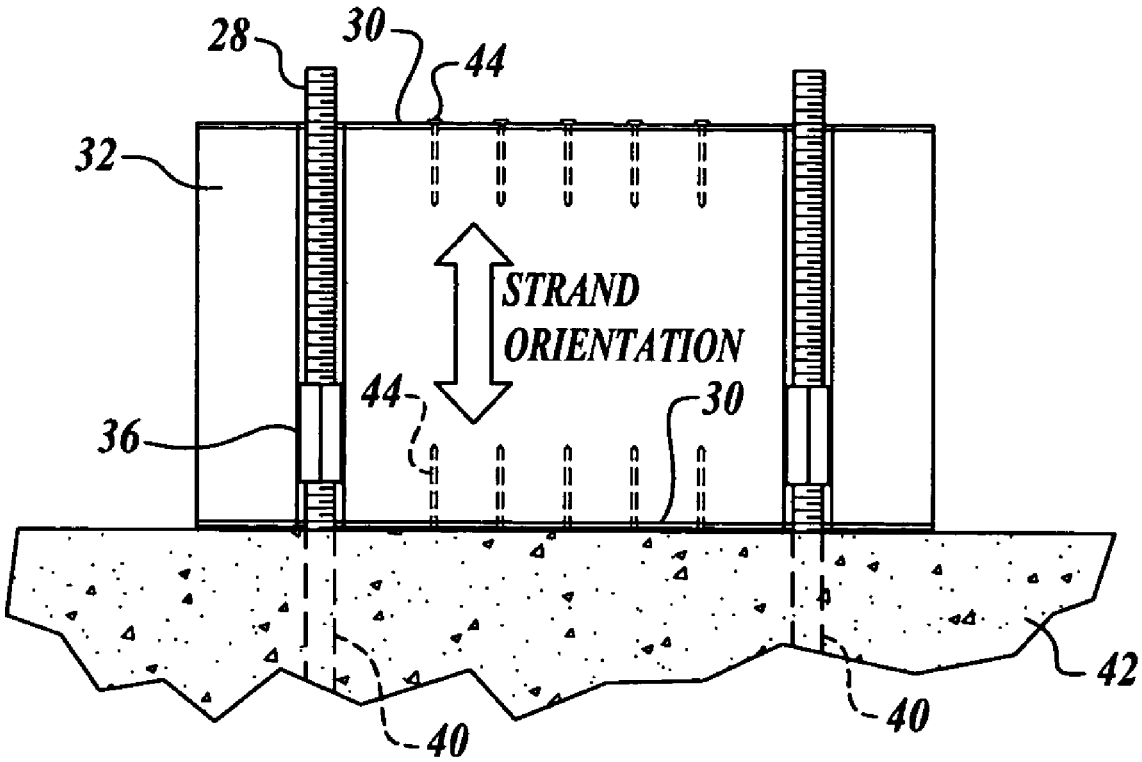
FIG. 3 is a plan view of the a portion of the raised floor assembly connected with a concrete foundation in accordance with an aspect of the present invention.

With specific reference to FIGS. 1-3, the block 32 is an engineered wood material. Typically, the engineered wood material includes wood strands that are resinated with an appropriate resin material and then formed into a strand orientation controlled mat assembly. Subsequently, the mat assembly is subjected to heat and pressure to cure and form the mat assembly into an engineered wood material of desired proportions. Suitable, non limiting examples of engineered wood material is a laminated strand wood product sold under the TimberStrand® mark and currently manufactured by Weyerhaeuser Company. This material has been produced and sold on the market for several years. As such, those skilled in the art are well aware of TimberStrand® properties and make-up, so a detailed description is not necessary herein to understand the present invention.

An embodiment of the present invention includes a block 32 that is configured to interact with at least two anchor bolts 40 in order to attach one pre-fabricated shear wall 22 to the anchor bolts 40 of a concrete wall or foundation 42. As such, the block 32 is suitably sized to encompass two anchor bolts 40. Those skilled in the art will appreciate that anchor bolt spacing is largely dependent upon the nature of the building, and its application. Additionally, anchor bolt spacing is also dependent upon local, regional and/or national building code requirements. Further, it is possible that a pre-fabricated shear wall may be sized to attach to more than two anchor bolts. As such, it will be appreciated that if a given design requires a pre-fabricated shear wall 22 that attaches to more than two anchor bolts 40, then the overall size of the block 32 may be increased to meet this need without exceeding the spirit and scope of this invention.

The pre-fabricated shear wall 22 is known in the art. As a result, a detailed description of shear walls is not required to understand the present invention. By way of example only, one suitable, non limiting example of a pre-fabricated shear wall is the TJ®-Shear Panel currently manufactured by Weyerhaeuser Company. However, any other pre-fabricated shear wall is considered within the scope of this invention.

Figure 4:
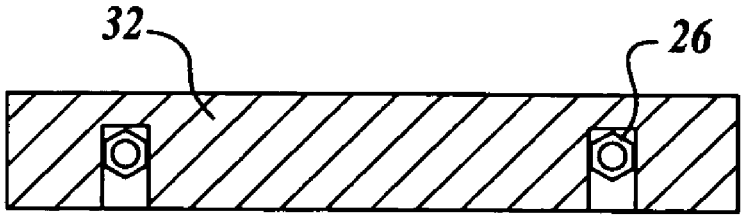
FIG. 4 is another sectional view of the assembly of FIG. 3, taken along cut line A-A.

With specific reference to FIGS. 2-4, grooves 34 are machined into the block 32 to provide a conduit for the connecting rod 28 to extend between the pre-fabricated shear wall 22 and the anchor bolt 40. One groove is cut for each connecting rod 28. The overall depth and or width of the grooves 24 is one of design choice, and will be variable based upon necessary design criteria and at least partially dependent upon the relative size (thickness) of the block 32. It will be appreciated that the overall size of a groove 24 should be sufficient to accept at least a portion of the connecting rod 28 without being overly large such that the size of the groove 34 relative to the size of the block 32 adversely affecting the integrity of the block 32. In other terms, the relative size (thickness/width) of the block 32 and depth/diameter of groove is determined, at least in part, by a need to properly support and align with a design appropriate pre-fabricated shear wall 22.

As discussed above, the block 32 is constructed of a plurality of resinated strands of wood material formed into an engineered wood product. In an embodiment, the block 32 is machined such that the wood strands are substantially parallel to the main axis of the groove 24, as best seen in FIG. 3. In another embodiment, the wood strands are substantially perpendicular to the main axis of the groove 24 (not shown).

The connecting rod 28 is typically a structurally sufficient rod that is threaded at least at both ends. However, it will be appreciated that the rod may be threaded the entire length if the application requires or such is otherwise desired. The rod may be a solid rod or it may be a hollow tube provided the tube provides adequate strength and other physical properties. The connecting rod 28 is attachable to the pre-fabricated shear wall 22 by threading into a hex nut 26, or other similar threaded connector within or otherwise attached to the pre-fabricated shear wall birdcage 24. The opposite end of the connecting rod 28 is attached to the anchor bolt 40 via a coupling nut 36.

Assisting in both maintaining the integrity of the block 32 and keeping proper connecting rod alignment is transfer plate 30. The transfer plate 30 is typically made from any suitable metallic material, such as, without limitation, steel, aluminum, or alloys thereof. In terms of shape, the transfer plate 30 generally sized to cover at least of mating surfaces of the pre-fabricated shear wall 22 and the block 32. Holes are defined through the transfer plate 30 such that their position corresponds to desired connecting rod spacing.

A second transfer plate 30 may also be use on an opposite surface of the block 32. This second transfer plate 30 may include slotted holes to allow easier insertion as best depicted in FIG. 2. The transfer plates 30 serve to transfer the shear force from the connecting rod 28, into the block 32, into the second transfer plate 30 back into the connecting rod 28 and into the anchor bolt 40. Suitable transfer plates 30 are known in the art, and as such a detailed description is not needed herein. However, it will be appreciated that the transfer plate be of sufficient geometry, thickness, and material property to perform its intended tasks. To this end, either or both transfer plates 30 may include fasteners 44 to help maintain the position of the transfer plate 30 relative to the block 32 and further assist in transferring the shear into or out of the associated element. Suitable, non limiting examples of fasteners 44 include nails and screws. However, other fasteners know in the art may also be used without exceeding the spirit and scope of this invention. For example, a suitable adhesive may be used, either alone or in combination with other fastener types.

Spacers 38 may also be used with the present invention. The spacers 38 are typically placed over the anchor bolt 40, adjacent the concrete wall 42.

Figure 5:
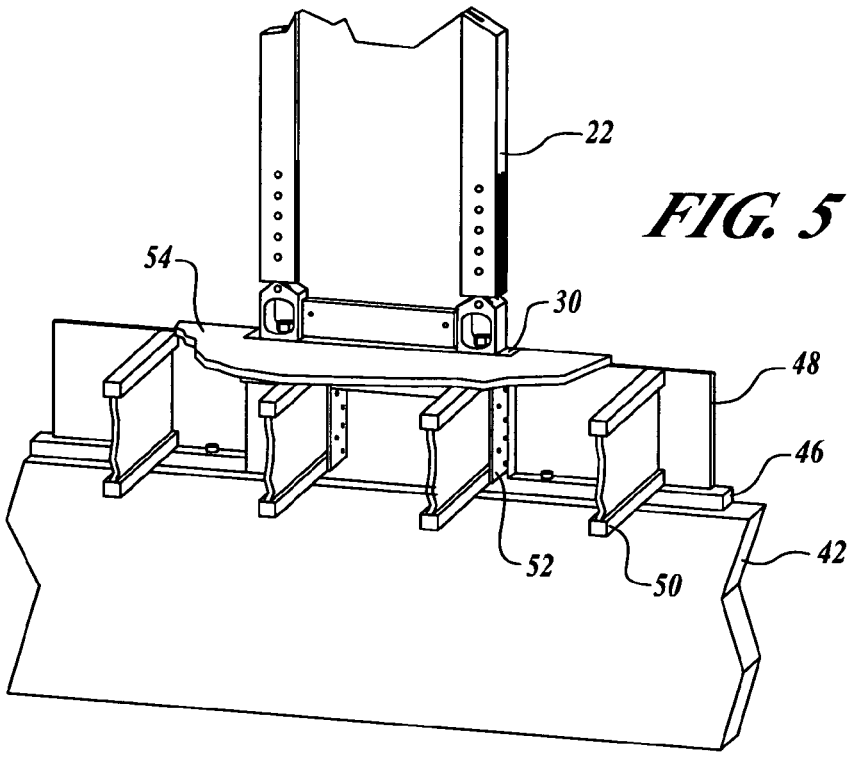
FIG. 5 is a perspective view of an assembled raised floor assembly in accordance with an aspect of the present invention.
Figure 6:
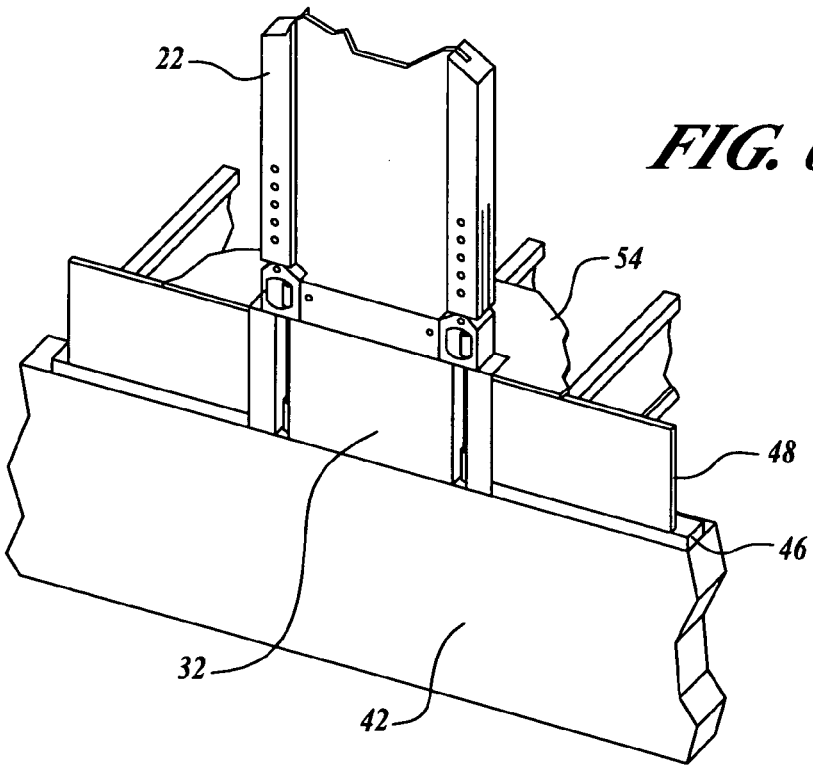
FIG. 6 is another perspective view of an assembled raised floor assembly in accordance with an aspect of the present invention; and, FIG. 7 is a plan view of an assembled raised floor assembly in accordance with an aspect of the present invention.
Figure 7:
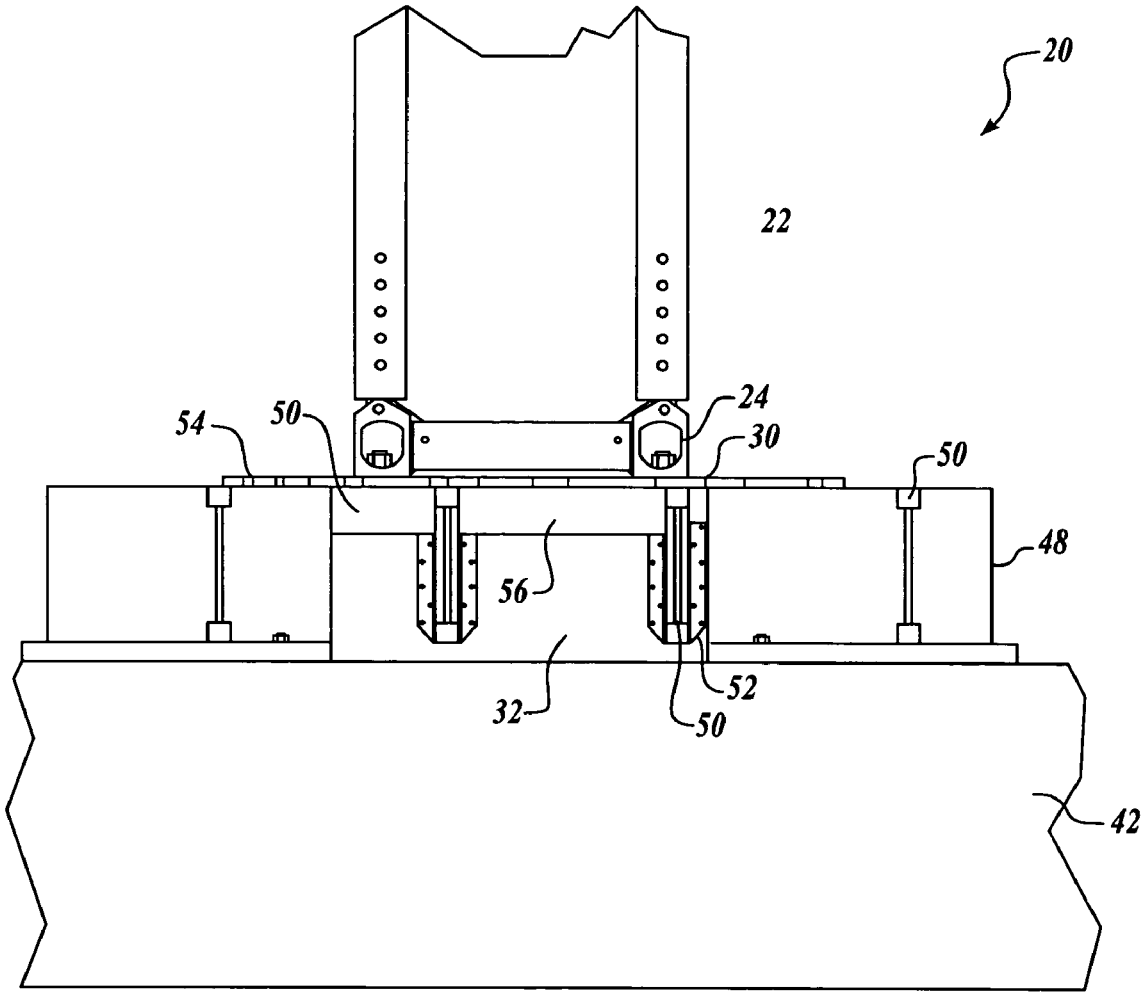

FIGS. 5-7 depict an aspect of the present invention in use. As illustrated, the raised floor assembly 20 is shown connecting pre-fabricated shear wall 22 with anchor bolts embedded within concrete wall 42. The block 32 interrupts the rim board 48 and the sill plate 46. The top of the block 32 is substantially level with the top surface of sheathing 54. The block 32 is placed with the grooves 34 facing opposite the joists 50. In this manner, joist hangers 52 may be attached to the opposite side of the block 32, thereby permitting joist spacing from being interrupted.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A pre-fabricated shear wall attachment assembly for attaching a pre-fabricated shear wall to an anchor bolt, comprising:

a block of engineered wood material, said block including a groove extending therethrough, said block of engineered wood being positioned between the pre-fabricated shear wall and the anchor bolt;

a coupling rod, said coupling rod being configured to attach the pre-fabricated shear wall to the anchor bolt, at least a portion of the coupling rod being within the groove; and a transfer plate positioned between the pre-fabricated shear wall and the block of engineered wood material, said coupling rod passing through said transfer plate.

2. The pre-fabricated shear wall attachment assembly of claim 1, further comprising spacers positioned between the block of engineered wood and the anchor bolt.

3. The pre-fabricated shear wall attachment assembly of claim 1, wherein the block of engineered wood product is a laminated strand lumber product.

4. The pre-fabricated shear wall attachment assembly of claim 1, wherein the block of engineered wood product is comprised of strands and the strands of the block of engineered wood product are substantially parallel with the groove.

5. The pre-fabricated shear wall attachment assembly of claim 1, furthering comprising a sheathing attached to the transfer plate;

one or more joists positioned under the sheathing, the grooves on the block being positioned opposite of the joists.

6. The pre-fabricated shear wall attachment assembly of claim 5 wherein the block has a top and a bottom, the top being substantially level with the sheathing.

7. A pre-fabricated shear wall attachment assembly for attaching a pre-fabricated shear wall to an anchor bolt, comprising:

a block of engineered wood material, the block including a groove extending through a first side, the block of engineered wood being positioned between the pre-fabricated shear wall and the anchor bolt;

a coupling rod, the coupling rod being configured to attach the pre-fabricated shear wall to the anchor bolt, at least a portion of the coupling rod being within the groove; and a transfer plate positioned between the pre-fabricated shear wall and the block of engineered wood material, the coupling rod passing through the transfer plate;

a sheathing attached to the transfer plate; and one or more joists positioned under the sheathing, the grooves on the block being positioned opposite of the joists.

8. The pre-fabricated shear wall attachment assembly of claim 7 wherein the transfer plate transfers shear loading from the shear wall and coupling rod, into the engineered wood material block, and then back into the coupling rod, to be dissipated into the anchor bolt.

9. The pre-fabricated shear wall attachment assembly of claim 7 wherein the pre-fabricated shear wall is attached to a foundation, the foundation, being a non-slab-on grade foundation.

10. The pre-fabricated shear wall attachment assembly of claim 7 wherein the block of engineered wood product is a laminated strand lumber product, the laminated strand product being comprised of strands, the strands being substantially parallel with the groove.

* * * * *